US006634683B1

(12) United States Patent
Brannan

(10) Patent No.: US 6,634,683 B1
(45) Date of Patent: Oct. 21, 2003

(54) SASH LOCK WITH HIDDEN MOUNTING SCREWS

(75) Inventor: Warren F. Brannan, King, NC (US)

(73) Assignee: Truth Hardware Corporation, Owatonna, MN (US)

( * ) Notice: Subject to any disclaimer, the term of this patent is extended or adjusted under 35 U.S.C. 154(b) by 0 days.

(21) Appl. No.: 09/666,571

(22) Filed: Sep. 21, 2000

Related U.S. Application Data

(60) Provisional application No. 60/155,818, filed on Sep. 23, 1999.

(51) Int. Cl.[7] ..... E05C 3/04

(52) U.S. Cl. ..... 292/241; 292/DIG. 47; 292/DIG. 20; 292/DIG. 7; 292/337

(58) Field of Search ..... 292/DIG. 47, DIG. 20, 292/DIG. 33, 241, DIG. 7, 337, 240, 202, 101

(56) References Cited

U.S. PATENT DOCUMENTS 4,356,667 A * 11/1982 Malachowski ..... 49/161
5,127,685 A * 7/1992 Dallaire et al. ..... 292/175
5,620,214 A * 4/1997 Kondratuk ..... 292/217
5,741,032 A * 4/1998 Chaput ..... 292/202
5,778,602 A * 7/1998 Johnson et al. ..... 49/449
5,927,767 A * 7/1999 Smith et al. ..... 292/158
5,927,771 A * 7/1999 Simon et al. ..... 292/241
6,135,511 A * 10/2000 Smith et al. ..... 292/156

* cited by examiner

*Primary Examiner*—Anthony Knight
*Assistant Examiner*—John B. Walsh
(74) *Attorney, Agent, or Firm*—Lorusso Loud & Kelly LLP

(57) ABSTRACT

The invention pertains to a window sash lock comprising a handle, a latch, a base and a base cover that fits over at least a substantial portion of the base and completely covers the base fasteners, while not interfering with the handle and latch. The base cover is typically a molded plastic design but may be formed as a metal stamping or fabricated from any suitable material. The base cover may be attached to the base by snap means or by an interference fit for easy removal and reinstallation so that the base cover can be replaced when decorating to provide a color, style or textural change.

9 Claims, 1 Drawing Sheet

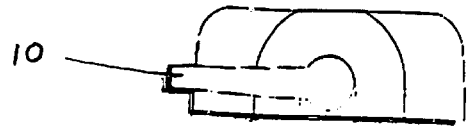
Fig. 1
Fig. 2
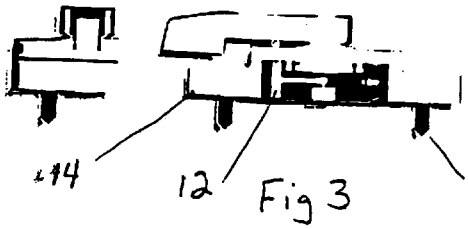
Fig 3
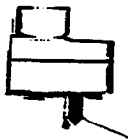
Fig 4
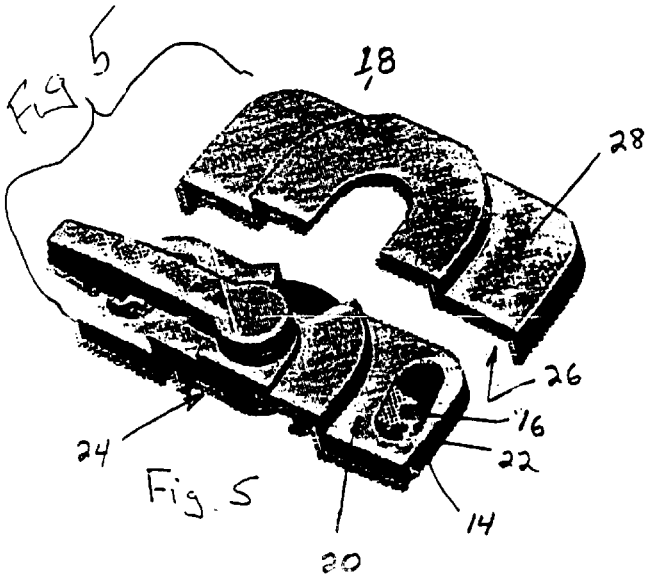
Fig. 5
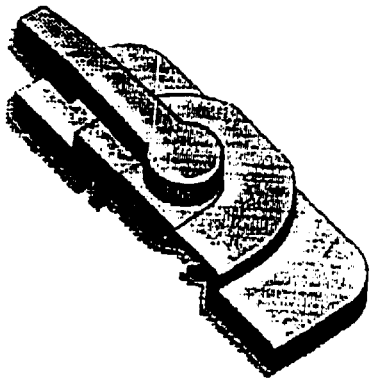
Fig. 6
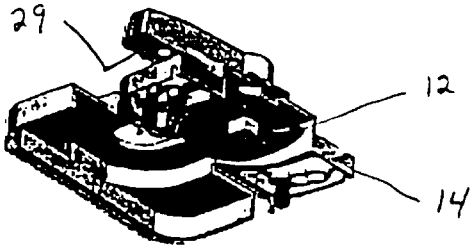
Fig. 7

SASH LOCK WITH HIDDEN MOUNTING SCREWS

CROSS-REFERENCE TO RELATED APPLICATIONS

This application claims the benefit of U.S. Provisional Application No. 60/155,818, filed Sep. 23, 1999.

BACKGROUND OF THE INVENTION

The invention relates to hardware and more particularly to a window lock mechanism and still more particularly to a cover for a window sash lock mechanism.

It is known that window sash locks are commonly attached to a window sash by fasteners, typically screws. A portion of the fastener, typically a screw head, remains exposed to view during the useful life of the sash lock.

It is also known that window hardware including sash locks serve an aesthetic or decorative purpose as well as a functional or mechanical purpose.

The aesthetic purpose of a sash lock is often degraded by the presence of exposed fasteners. Fasteners often rust or exhibit burrs or other damage which contrast starkly with a neat aesthetic design of the sash lock and other window hardware.

It is known that the aesthetic qualities of the sash lock fasteners may be improved by covering the fasteners together with the sash lock with one or more coats of paint. However painting the fasteners typically provides only marginal aesthetic improvement. Furthermore, paint often chips thereby causing a more significantly deteriorated appearance of the fasteners.

Plugs are known to be used for covering fasteners in the carpentry art wherein plugs are press fit into fastener holes that guide countersunk fasteners. Such plugs are not suitable where the fastener is not countersunk into a fastener hole. Window sash lock bases are frequently not deep enough to provide sufficient countersink depth to facilitate using such plugs. Furthermore, such plugs may provide only marginal aesthetic improvement to an exposed fastener.

SUMMARY OF THE INVENTION

Accordingly, the invention comprises a window sash lock base cover which fits over at least a substantial portion of the sash lock base and completely covers the sash lock base fasteners. The sash lock base cover is typically a molded plastic design but may also be formed as a metal stamping or fabricated from any suitable material. A molded plastic housing cover provides for custom color, style and texture variations.

The sash lock base cover may be attached to the sash lock base by either a snap fit or an interference fit to the sash lock base. Both snap fit and interference fit designs provide for easy removal and reinstallation of the sash lock base cover.

It is a principal advantage of the invention to provide an easily installable aesthetic improvement to window sash locks. It is another advantage of the invention to provide that the aesthetic improvement be easily changed, modified or replaced for aesthetic variation or further aesthetic improvement.

BRIEF DESCRIPTION OF THE DRAWINGS

FIG. 1 is a top elevation view of a sash lock with a sash lock base cover installed in accordance with the present invention.

FIG. 2 is a sectional side view of a sash lock with a sash lock base cover installed in accordance with the present invention.

FIG. 3 is a frontal sectional view of a sash lock with a sash lock base cover installed in accordance with the present invention.

FIG. 4 is a side view of a sash lock with a sash lock base cover installed in accordance with the present invention.

FIG. 5 is an exploded isometric top view of a sash lock and a sash lock base cover in accordance with the present invention.

FIG. 6 is an isometric top view of a sash lock with the sash lock base cover installed in accordance with the present invention.

FIG. 7 is an exploded isometric bottom view of a sash lock and a sash lock base cover in accordance with the present invention.

DETAILED DESCRIPTION OF THE INVENTION

Attention is drawn to an embodiment of the invention, which is a combination of a window sash lock having a locking mechanism comprising handle 10, a latch 12, a dye cast base 14 which is typically mounted to a window frame with fasteners 16 typically screws or bolts and a molded plastic sash lock base cover 18. The base has a top side 20, a closed edge surface 22 and an open edge surface 24 through which the latch 12 may protrude. The base cover 18 comprises essentially a thin shell which fits over the base top side 20 and closed edge surfaces 22 and is shaped to conform closely to the base 14. The base cover 18 has an open edge surface 26 which, in one embodiment, is perpendicular to its top side 28 (described below) and which aligns with the base open edge surface 24 so that the base cover 18 does not interfere with the path of the latch 12. As previously noted, the base cover has a top side 28 which is thin enough to fit between the base top side 20 and a bottom side 29 of the handle so that the base cover 18 does not substantially interfere with the path of the handle 10. The top side 28 of the base cover 18 covers the base fasteners 16 and may be made in various colors, styles or textures. The base cover 18 may be attached to the base 14 by snap means (not shown) or by an interference fit so that the base cover 18 can be replaced when decorating to provide a color change, style change or texture change.

I claim:

1. A window sash lock apparatus comprising:

a sash lock mechanism base assembly; and a sash lock base cover that is aperture free except for a slot, said sash lock base cover further comprising:
- a top side;
- a closed edge surface; and
- an open edge surface perpendicular to said top side through which a sash
- lock latch may protrude;
- said sash lock base cover fitting over and essentially conforming to a top side and closed edge surface of said sash lock mechanism base assembly;
- said sash lock base cover further fitting substantially clear of a path of a sash lock handle.

2. The apparatus of claim 1 wherein said sash lock mechanism base assembly comprises at least one fastener and wherein said at least one fastener is covered by the top side of said sash lock base cover.

3. The apparatus of claims 1 or 2 wherein said sash lock base cover is made from a thermoplastic molded material.

4. The apparatus of claim 3 wherein said sash lock base cover is attached to said sash lock mechanism base assembly by at least one snap feature in said sash lock base cover having an undercut area which extends a mating feature of said sash lock base mechanism.

5. The apparatus of claim 4 wherein said snap feature is capable of multiple excursions to allow removal and reinstallation of said sash lock base cover.

6. The apparatus of claim 1 or 2 wherein said sash lock base cover is attached to said sash lock mechanism base assembly by an interference fit.

7. The apparatus of claim 3 wherein said sash lock base cover is attached to said sash lock mechanism base assembly by an interference fit.

8. The apparatus of claim 1 wherein said slot is defined in a portion of said top side.

9. The apparatus of claim 1 wherein said slot is open to said open edge surface.

* * * * *